US007275524B2

(12) United States Patent
Schelhas et al.

(10) Patent No.: US 7,275,524 B2
(45) Date of Patent: Oct. 2, 2007

(54) NON-RETURN FUEL SUPPLY SYSTEM

(75) Inventors: Peter Schelhas, Stuttgart (DE); Andreas Herforth, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 408 days.

(21) Appl. No.: 10/509,591

(22) PCT Filed: Jul. 11, 2003

(86) PCT No.: PCT/DE03/02336

§ 371 (c)(1),
(2), (4) Date: Sep. 29, 2004

(87) PCT Pub. No.: WO2004/053318

PCT Pub. Date: Jun. 24, 2004

(65) Prior Publication Data

US 2005/0175488 A1 Aug. 11, 2005

(30) Foreign Application Priority Data

Dec. 7, 2002 (DE) ..... 102 57 280
Jun. 18, 2003 (DE) ..... 103 27 562

(51) Int. Cl.
*F02M 37/04* (2006.01)

(52) U.S. Cl. ..... 123/514; 123/446

(58) Field of Classification Search ..... 123/514, 123/456, 446, 179.17, 506, 509, 458; 137/571, 137/568, 566, 115.05, 115.08
See application file for complete search history.

(56) References Cited

U.S. PATENT DOCUMENTS 4,926,829 A * 5/1990 Tuckey ..... 123/497
5,289,810 A * 3/1994 Bauer et al. ..... 123/510
5,392,750 A * 2/1995 Laue et al. ..... 123/509
5,732,684 A * 3/1998 Thompson ..... 123/514
5,749,345 A * 5/1998 Treml ..... 123/456
5,791,317 A * 8/1998 Eck ..... 123/510
6,024,064 A * 2/2000 Kato et al. ..... 123/179.17
6,457,459 B1 * 10/2002 Schelhas et al. ..... 123/514
2001/0004889 A1 * 6/2001 Schreckenberger ..... 123/457
2001/0018908 A1 * 9/2001 Joos et al. ..... 123/497
2002/0020397 A1 2/2002 Begley et al.
2002/0043253 A1 4/2002 Begley et al.
2003/0183199 A1 * 10/2003 Vahle et al. ..... 123/458

FOREIGN PATENT DOCUMENTS

DE 41 23 367 A1 1/1993
DE 199 13 477 A1 10/2000
DE 199 51 132 A1 5/2001
DE 100 58 674 A1 6/2002
EP 1 195 514 A2 4/2002

* cited by examiner

*Primary Examiner*—Carl S. Miller
(74) *Attorney, Agent, or Firm*—Ronald E. Greigg

(57) ABSTRACT

A return-flow-free fuel supply system for an internal combustion engine having at least one fuel pump for pumping fuel from a first region of a fuel reservoir into a pressure region communicating with a fuel distributor, at least one suction jet pump, through which fuel pumped through a suction jet pump line by means of the fuel pump flows and through which fuel can be pumped from a second region of the fuel reservoir into the first region, at least one means that regulate and/or control the pressure in the pressure region, and at least one check valve, by which at least a portion of the pressure region can be blocked off from the fuel pump. The means that regulate and/or control the pressure in the pressure region include at least one electrically actuatable magnet valve(40,44), which is disposed downstream of the check valve in the suction jet pump line.

20 Claims, 2 Drawing Sheets

NON-RETURN FUEL SUPPLY SYSTEM

CROSS-REFERENCE TO RELATED APPLICATIONS

This application is a 35 USC 371 application of PCT/DE 03/02336 filed on Jul. 11, 2003.

BACKGROUND OF THE INVENTION

1. Field of the Invention

The invention is directed to an improved return-flow-free fuel supply system of the type employed with an internal combustion engine.

2. Description of the Prior Art

In a fuel supply system for an internal combustion engine, fuel from a fuel tank is pumped by a fuel pump via a pressure line to a fuel distributor, located on the engine and having injection valves, or to a gasoline or Diesel high-pressure pump. Modern fuel supply systems have a built-in tank unit, inserted into the fuel tank, and the fuel pump, an intake filter, and a pot as a fuel reserve are integrated with it; the pot is filled with one or more suction jet pumps. The suction jet pumps consequently assure that even when the fuel level in the fuel tank is dropping, the pot is always completely filled in order to furnish the reserve fuel. The suction jet pumps are disposed in the suction jet pump line, which branches off from the pressure line and discharges into the pot.

In modern fuel supply systems, a return line branches off from the fuel distributor and leads back into the fuel tank. The quantity of fuel not needed by the engine then flows through the fuel distributor back into the fuel tank via the return line. Conversely, in return-flow-free fuel supply systems known for instance from German Patent Disclosure DE 199 51 132 A1, no return line from the fuel distributor to the fuel tank is provided. Instead, the fuel in the fuel distributor is regulated as needed, by measuring the actual fuel pressure with a pressure sensor, comparing it inside a control unit with a set-point fuel pressure stored in a performance graph, and varying the rpm of the fuel pump as a function of the regulated difference. A check valve in the pressure line, downstream of the fuel pump, assures sealing of the pressure region that contains the fuel distributor. The regulating function is performed as long as the engine is operated under load and a quantity of fuel to be consumed is called for.

During phases in which the injection valves are closed and the fuel pump is not pumping fuel into the pressure line, for instance in a stopped phase of the engine, the pressure in the pressure line which is tight on the one hand because of the closed injection valves and on the other because of the closed check valve can rise at high temperatures, and therefore mechanically actuated pressure limiting valves or diaphragm pressure regulators are used to keep the pressure constant in the pressure line. One type of such pressure limiting valves must be constantly rinsed during operation by a slight overflow quantity, which on the one hand necessitates constant operation of the fuel pump and consequently a certain energy consumption; on the other hand, because of the slight rinsing quantity, there is the risk that dirt will become deposited on the valve seat. Another type of pressure limiting valve is closed in operation, so that after a nonpumping phase and at the onset of load operation, because of the sudden pressure rise that then occurs, both excessively rich mixtures and also, because of the higher leakage at the injection valves resulting from the pressure, higher hydrocarbon emissions can occur. Moreover, in both types of pressure limiting valves, the opening pressure cannot be varied during operation.

SUMMARY AND ADVANTAGES OF THE INVENTION

Because the means that regulate and/or control the pressure in the pressure region include at least one electrically actuatable magnet valve which is disposed downstream of the check valve in the suction jet pump line, the magnet valve can be incorporated into the electronic regulation of the engine, which makes it possible to regulate the system pressure and the fuel quantity under all operating states of the engine, and in particular during overrunning and in a stopped phase. Then in contrast to the mechanically hydraulically actuated valves in the prior art, variable opening pressures can be set via the electrically actuatable magnet valve, depending on its opening duration. This is especially advantageous to compensate for temperature-caused pressure changes. Finally, in electrically actuatable magnet valves, the requirement for constant rinsing is eliminated, and therefore the fuel pump can be made smaller, and the risk of soiling of the valve seat is reduced substantially.

In a preferred way, the magnet valve is disposed between the check valve and the suction jet pump and is triggered by a central engine control unit; the triggering of the magnet valve is effected as a function of the pressure measured by a pressure sensor disposed in the pressure region. As a result of this provision, the magnet valve is integrated with the electronic engine control unit, and variable opening pressures can be achieved as a result. The pressure region communicating with injection valves is preferably formed by a pressure line which connects the fuel pump with the injection valves.

In a first embodiment, an inlet of the magnet valve communicates with the pressure region, and an outlet communicates with the suction jet pump. In particular, during a stopped phase of the engine the magnet valve is closed when without current and otherwise, for instance during normal operation under load and during overrunning, it is open with current. In the event of a pressure increase, for instance caused by temperature, during the stopped phase, the magnet valve is opened by signals from the engine control unit in order to keep the pressure in the pressure line constant. Because of the electronic regulation of the magnet valve, the holding pressure in particular can be defined arbitrarily during overrunning and when the engine is stopped. However, this also means that the function of the engine control unit must be maintained temporarily, even during the stopped phase of the engine.

This provision can be dispensed with in a second embodiment, in which the magnet valve is formed by a 3/2-way valve, of which an inlet communicates with the pressure line, a first outlet communicates with the suction jet pump, and a second outlet communicates with a pressure limiting valve. This 3/2-way valve is controlled by the engine control unit such that in a currentless state it connects the inlet with the second outlet, while in the state with current it connects the inlet with the first outlet. Consequently, when the engine is stopped and the engine control unit is without current and hence deactivated, the 3/2-way valve automatically, for instance by spring prestressing, switches into its currentless position, in which the pressure line communicates with the pressure limiting valve, by way of which overpressure is then reduced again. In normal operation under load or in engine overrunning, the 3/2-way valve is conversely supplied with current by the engine control unit, so that the suction jet pump is connected to the pressure line.

In another version of the invention, the triggering of the magnet valve is effected as a function of a filling ratio of fuel in the fuel tank that forms the second region of the fuel reservoir. Within the fuel tank, the pot that receives the fuel pump and then forms the first region of the fuel reservoir is provided as a reservoir for the reserve fuel. If the magnet valve is closed when the fill level in the fuel tank is in a range between maximum filling and a level which is essentially aligned with the upper edge of the pot, then the fuel is no longer pumped from the fuel tank into the pot via the suction jet pump, which is put out of operation by the closed magnet valve. Instead, to equalize the levels, the fuel then flows out of the fuel tank into the pot over the edge of the pot. Given a sufficient filling ratio in the fuel tank, the suction jet pump can consequently be put out of operation, which results in a notable reduction in the pumping capacity required of the fuel pump, an increase in system efficiency, less burden on the on-board electrical system, less tank heating, and a longer service life of the fuel pump.

A further version provides that the magnet valve is formed by a switching valve, which is triggered in clocked fashion to regulate the propellant pressure of the suction jet pump. In an alternative to this, the magnet valve may be a proportional valve, which is triggered to regulate the propellant pressure of the suction jet pump. In both cases, the suction jet pump can always be operated in a range of maximum efficiency.

Consequently, in the sense of a multiple function, the magnet valve not only serves to provide especially advantageous regulation of the system pressure and fuel quantity during overrunning and when the engine is stopped, but also to attain further energy-saving provisions.

BRIEF DESCRIPTION OF THE DRAWINGS

Other features and advantages of the invention will become apparent from the description combined herein below, taken in conjunction with the drawings, in which.

DESCRIPTION OF THE PREFERRED EMBODIMENTS

Figure 1:
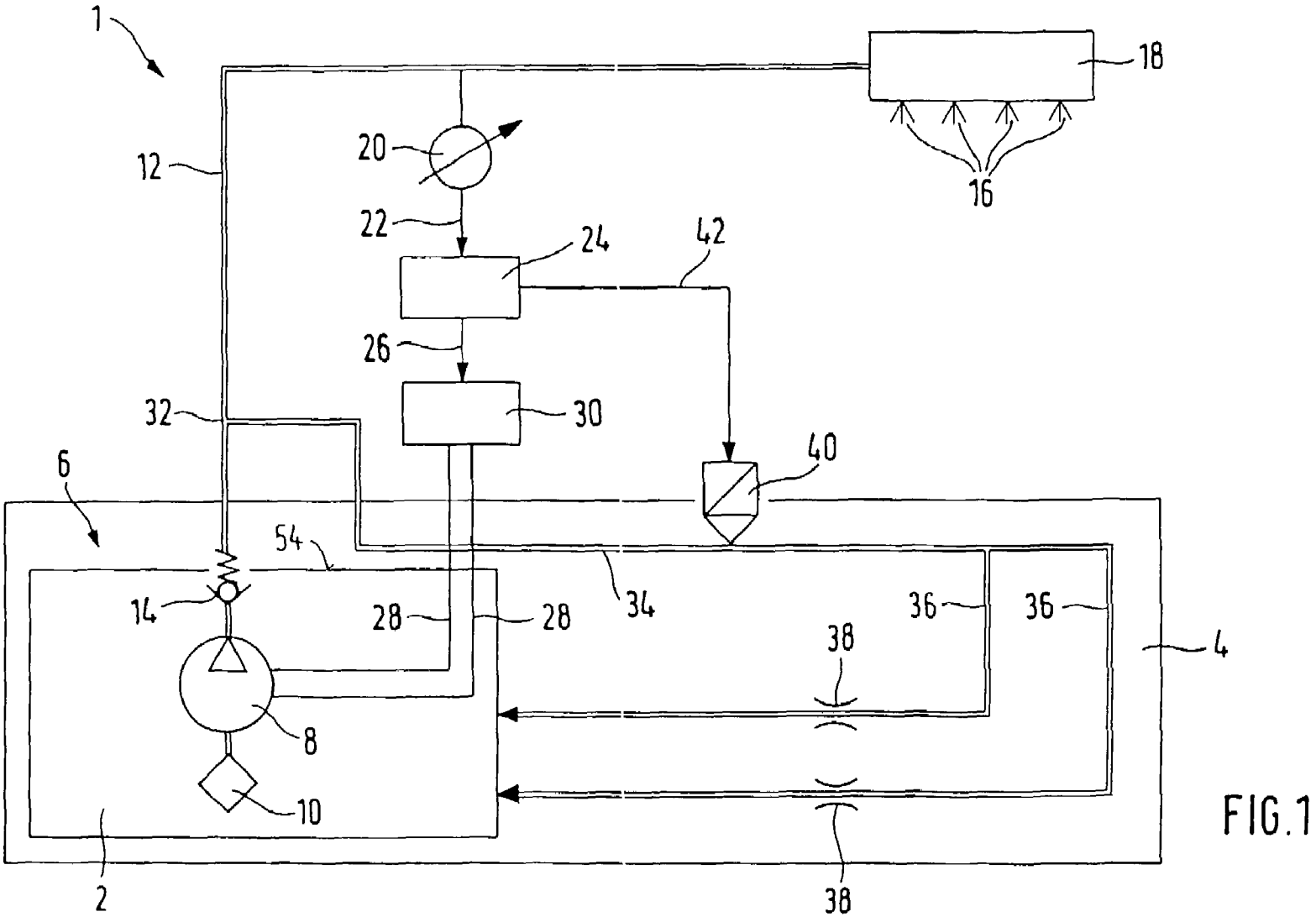
FIG. 1 is a schematic illustration of a preferred embodiment of a fuel supply system of the invention.

The return-flow-free fuel supply system identified overall by reference numeral 1 in FIG. 1 serves for instance to supply fuel to an internal combustion engine of a vehicle, and as its essential components it includes a built-in tank unit 6, retained inside a swirl pot 2 of a fuel tank 4, that includes a fuel pump 8 with an intake filter 10 on the infeed side, a check valve 14 disposed in a pressure line 12 on the pressure side with respect to the fuel pump 8, and a fuel distributor 18, communicating fluidically with injection valves 16, or a gasoline or Diesel high-pressure pump. In a region between the check valve 14 and the fuel distributor 18, a pressure sensor 20 measures the actual pressure in the pressure line 12 and sends a signal accordingly over a signal line 22 to a control unit, which is preferably formed by a central engine control unit 24 (MOTRONIC), and in which, as a function of a regulated difference between the actual pressure and a demand-oriented set-point pressure, a control signal is sent over an electric line 26 to an electronic fuel pump control unit 30, which communicates with the fuel pump 8 over electric lines 28, in order to reregulate the pressure in the pressure line 12 as needed via the fuel pump 8.

From a portion of the pressure line 12 that is downstream with respect to the check valve 14, a suction jet pump line 34 branches off at a branching point 32; this line, branching off for instance into a plurality of individual lines 36, preferably two of them, contains one suction pump 38, through which fuel flows, in each branch 36, and the individual lines 36 discharge into the swirl pot 2. The swirl pot 2 serves on the one hand as a fuel reservoir; on the other, in the event of major lateral acceleration, it briefly prevents the fuel pump 8 from aspirating any more fuel, because as a consequence of centrifugal force this fuel is concentrated in a portion of the fuel tank 4 remote from the intake side. In the state in which fuel flows through them, the suction jet pumps 38 aspirate fuel, from the region of the fuel tank 4 located outside the swirl pot, into the two individual lines 36 and in a known way assure a constant fuel level inside the swirl pot 2.

An electrically actuatable magnet valve 40 is disposed in the suction jet pump line 34 branching off from the pressure line 12; this magnet valve is triggered by the central engine control unit 24 via a control line 42, preferably as a function of the measured pressure in the pressure line 12, the temperature of the fuel, the fill level, and/or engine operating conditions. The magnet valve 40 is embodied so as to open or close the cross section of the suction jet pump line 34. Preferably, the magnet valve 40 is closed when without current and open when with current.

With the above as background, the mode of operation of the fuel supply system 1 is as follows: In engine operation under load, the fuel pump 8 aspirates fuel from the swirl pot 2; under the influence of the fuel pressure, the fuel stream opens the check valve 14, and some of the fuel stream flows at the branching port 32 into the suction jet pump line 34. In operation under load, the engine control unit 24 supplies current to the magnet valve 40, whereupon the magnet valve is switched into the open position, so that the suction jet pumps 38 can aspirate fuel, from the region of the fuel tank 4 located outside the swirl pot 2, into the swirl pot 2. The rest of the fuel stream is delivered as needed along the pressure line 12 to the fuel distributor 18, so that it can be injected via the injection valves 16 into combustion chambers of the engine.

In the overrunning mode, the injection valves 16 are closed, so that the fuel flow in the pressure line 12 is equal to zero; at the same time, because the magnet valve 40 continues to be supplied with current and is thus kept open, the suction jet pump line 34 has a flow of fuel through it and consequently feeds fuel into the swirl pot 2.

Conversely, during a stopped phase of the engine, the engine control unit 24 switches the magnet valve 40 to be currentless, whereupon the magnet valve closes. Consequently, the portion of the pressure line 12 downstream of the check valve 14 and the portion of the suction jet pump line 34 upstream of the magnet valve 40 are sealed off from the environment by the closed injection valves 16, the closed magnet valve 40, and the check valve 14 that is closed toward the fuel pump 8, and the pressure of the fuel quantity present in these portions is supposed to be kept constant. For reasons of temperature, however, the holding pressure may be too high, which is detected by the pressure sensor 20 and reported to the central engine control unit 24. The magnet valve 40 is then briefly switched into its open position by the engine control unit 24, by means of a current pulse, in order to reduce the specified holding pressure.

Figure 2:
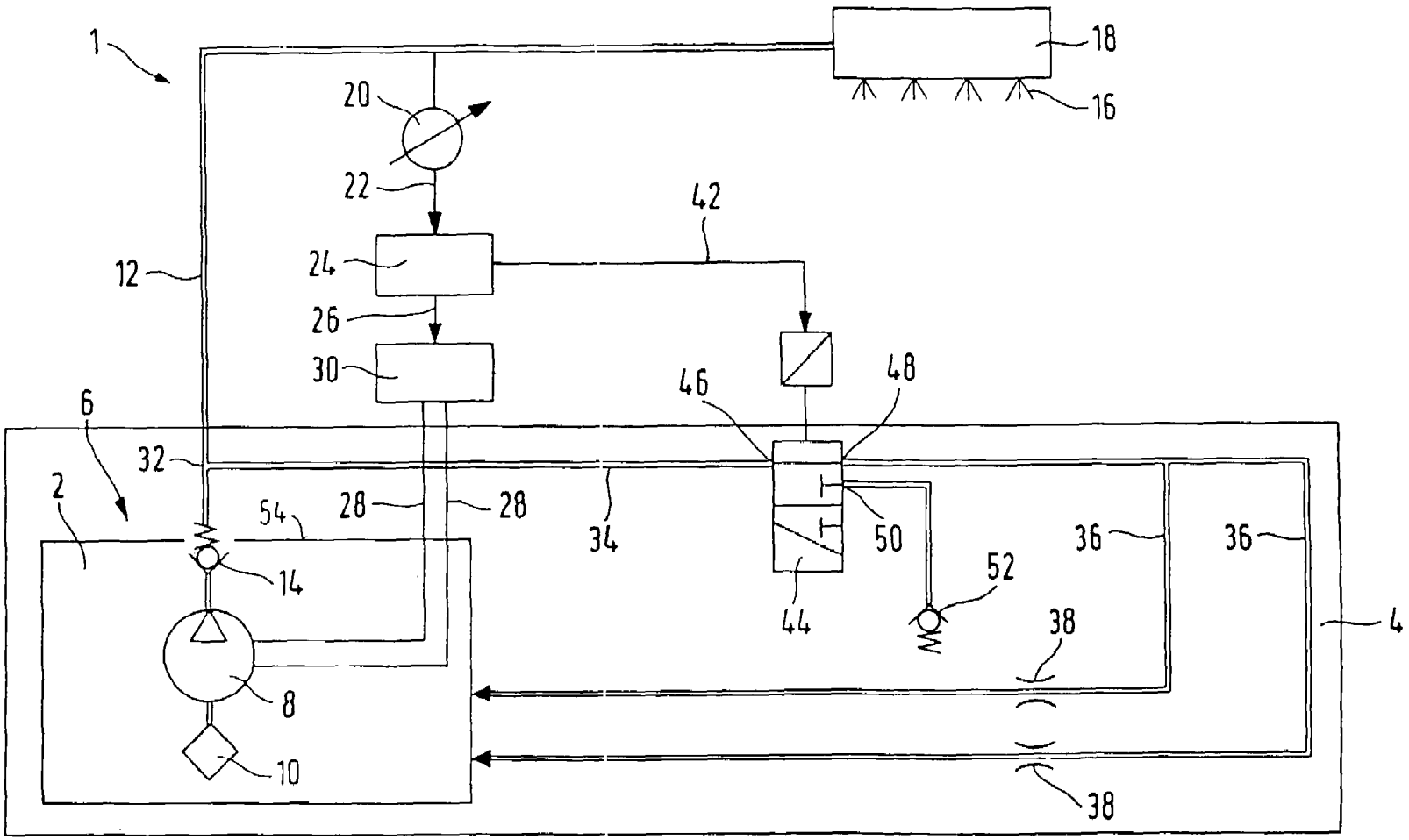
FIG. 2 is a schematic illustration of a further embodiment of a fuel supply system of the invention.

In the second exemplary embodiment of the invention shown in FIG. 2, those elements that remain the same and function the same as in the above example are identified by the same reference numerals. As the magnet valve, a 3/2-way valve 44 is used here, of which an inlet 46 communicates with the pressure line 12, a first outlet 48 communicates with the suction jet pumps 38, and a second outlet 50 communicates with a pressure limiting valve 52. The 3/2-way valve 44 is triggered by the central engine control unit 24 in such a way that in the currentless state, it connects the inlet 46 with the second outlet 50, and in the state supplied with current it connects the inlet 46 with the first outlet 48. Preferably, the 3/2-way valve 44 is switched to be currentless during a stopped phase of the engine, and otherwise, that is, in operation under load and in overrunning, it is supplied with current. Consequently, upon stoppage of the engine and with the engine control unit 24 deactivated and without current, the 3/2-way valve 44 automatically, for instance by spring prestressing, switches into its currentless position, in which the pressure line 12 communicates with the pressure limiting valve 52, by way of which valve overpressure can then be reduced. In normal operation under load or in the overrunning mode of the engine, conversely, the 3/2-way valve 44 is supplied with current by the engine control unit 24, so that the suction jet pumps 38 are connected to the pressure line 12.

In a further development of the first version shown in FIG. 1, the triggering of the magnet valve 40 is effected as a function of a fuel filling ratio in the fuel tank 4. If the magnet valve 40 is closed when the fill level in the fuel tank 4 is in a range between maximum filling and a level which is essentially aligned with the upper edge 54 of the swirl pot 2, then the fuel is no longer fed into the swirl pot 2 from the fuel tank 4 via the suction jet pumps 38, which have been put out of operation because of the closed magnet valve 40. Instead, to equalize the levels, the fuel then flows out of the fuel tank 4 over the edge 54 of the swirl pot 2 and into this swirl pot. Given an adequate filling ratio in the fuel tank 4, the suction jet pumps 38 can consequently be put out of operation. It is furthermore possible to vary the shutoff pressure as a function of the temperature and/or engine operating conditions.

Both putting the suction jet pumps 38 out of operation and varying the shutoff pressure can also be effected by the 3/2-way valve 44 in the second embodiment shown in FIG. 2, if at the above-described, adequate level in the fuel tank 4 the magnet valve is switched in such a way that the inlet 46 communicates with the second outlet 50, which discharges into the pressure limiting valve 52. Then, the part of the suction jet pump line 34 located downstream of the 3/2-way valve 44 is blocked up to a predetermined pressure level, so that the suction jet pumps 38 are no longer supplied with fuel.

Since in the embodiments of FIG. 1 and FIG. 2 the magnet valves 40, 44 are preferably switching valves, they can be triggered in clocked fashion to regulate the propellant pressure of the suction jet pumps 38. In an alternative to this, the magnet valve 40, 44 may also be a proportional valve, which is triggered to regulate the propellant pressure of the suction jet pump. By means of regulating the propellant pressure, the suction jet pumps 38 can then always be operated in a range of maximum efficiency.

The foregoing relates to preferred exemplary embodiment of the invention, being understood that other variants and embodiments thereof are possible within the spirit and scope of the invention, the latter being defined by the appended claims.

The invention claimed is:

1. A return-flow-free fuel supply system (1) for an internal combustion engine, in particular of a motor vehicle, the system comprising at least one fuel pump (8), by means of which fuel can be pumped from a first region (2) of a fuel reservoir into a pressure region (12) communicating with a fuel distributor (18), at least one suction jet pump (38), through which fuel pumped through a suction jet pump line (34) by means of the fuel pump (8) flows and through which fuel can be pumped from a second region (4) of the fuel reservoir into the first region (2), at least one means (20, 24, 30) that regulate and/or control the pressure in the pressure region (12), and at least one check valve (14), by which at least a portion of the pressure region (12) can be blocked off from the fuel pump (8), the means (20, 24, 30) that regulate and/or control the pressure in the pressure region (12) including at least one electrically actuatable magnet valve (40; 44), disposed downstream of the check valve (14) in the suction jet pump line (34).

2. The return-flow-free fuel supply system of claim 1, wherein the magnet valve (40; 44) is disposed between the check valve (14) and the suction jet pump (38).

3. The return-flow-free fuel supply system of claim 1, wherein the magnet valve (40; 44) is triggered by an electronic engine control unit (24).

4. The return-flow-free fuel supply system of claim 2, wherein the magnet valve (40; 44) is triggered by an electronic engine control unit (24).

5. The return-flow-free fuel supply system of claim 3, further comprising a pressure sensor (20) disposed in the pressure region (12), the triggering of the magnet valve (40; 44) being effected as a function of the pressure measured by the pressure sensor (20).

6. The return-flow-free fuel supply system of claim 4, further comprising a pressure sensor (20) disposed in the pressure region (12), the triggering of the magnet valve (40; 44) being effected as a function of the pressure measured by the pressure sensor (20).

7. The return-flow-free fuel supply system of claim 1, wherein an inlet of the magnet valve (40) communicates with the pressure region (12), and an outlet of the magnet valve (40) communicates with the suction jet pump (38).

8. The return-flow-free fuel supply system of claim 7, wherein the magnet valve (40), during a stopped phase of the engine, is closed when without current and is open when with current.

9. The return-flow-free fuel supply system of claim 1, further comprising a pressure limiting valve (52), the magnet valve being formed by a 3/2-way valve (44), having an inlet (46) communicating with the pressure region (12), a first outlet (48) communicating with the suction jet pump (38), and a second outlet (50) communicating with the pressure limiting valve (52).

10. The return-flow-free fuel supply system of claim 9, wherein the 3/2-way valve (44) is triggered such that in the currentless state, it connects the inlet (46) with the second outlet (50), and in the state with current it connects the inlet (46) with the first outlet (48).

11. The return-flow-free fuel supply system of claim 9, wherein the 3/2-way valve (44) is currentless during a stopped phase of the engine and otherwise is supplied with current.

12. The return-flow-free fuel supply system of claim 1, wherein the pressure region communicating with the fuel distributor (18) is formed by a pressure line (12), which connects the fuel pump (8) with injection valves (16).

13. The return-flow-free fuel supply system of claim 12, wherein the suction jet pump line (34) branches off from the pressure line (12) downstream of the check valve (14).

14. The return-flow-free fuel supply system of claim 1, wherein that the triggering of the magnet valve (40; 44) is effected as a function of a fuel filling ratio of the second region (4) of the fuel reservoir.

15. The return-flow-free fuel supply system of claim 2, wherein that the triggering of the magnet valve (40; 44) is effected as a function of a fuel filling ratio of the second region (4) of the fuel reservoir.

16. The return-flow-free fuel supply system of claim 3, wherein that the triggering of the magnet valve (40; 44) is effected as a function of a fuel filling ratio of the second region (4) of the fuel reservoir.

17. The return-flow-free fuel supply system of claim 14, wherein the first region of the fuel reservoir is formed by a pot (2) that receives the fuel pump (8) and is disposed inside the second region (4) of the fuel reservoir.

18. The return-flow-free fuel supply system of claim 17, wherein the magnet valve (40; 44) is closed when the liquid level in the second region (4) of the fuel reservoir is in a range between maximum filling and a level which is essentially level with an upper edge of the pot, and that otherwise it is open.

19. The return-flow-free fuel supply system of claim 1, wherein the magnet valve (40; 44)is formed by a switching valve, which is triggered in clocked fashion for regulating the propellant pressure of the suction jet pump (38).

20. The return-flow-free fuel supply system of claim 1, wherein the magnet valve is formed by a proportional valve (40; 44), which is triggered for regulating the propellant pressure of the suction jet pump (38).

* * * * *